US006575661B1

(12) United States Patent
Phillips et al.

(10) Patent No.: US 6,575,661 B1
(45) Date of Patent: Jun. 10, 2003

(54) BOAT LIFT

(75) Inventors: John Phillips, Niagara Falls, NY (US); Gregory A. Gorecki, Eden, NY (US); Alfred J. Ulrich, Alden, NY (US)

(73) Assignee: Reimann & Georger, Buffalo, NY (US)

( * ) Notice: Subject to any disclaimer, the term of this patent is extended or adjusted under 35 U.S.C. 154(b) by 0 days.

(21) Appl. No.: 09/989,346

(22) Filed: Nov. 20, 2001

(51) Int. Cl.[7] ..... B63C 3/06

(52) U.S. Cl. ..... 405/3; 405/7; 114/44; 414/678

(58) Field of Search ..... 405/3, 1, 4, 5, 405/6, 7, 2; 114/44, 75, 78; 414/678

(56) References Cited

U.S. PATENT DOCUMENTS

| | | | | | |
|---|---|---|---|---|---|
| 2,505,832 | A | | 5/1950 | Lange | |
| 2,585,664 | A | * | 2/1952 | May et al. | 405/3 |
| 2,963,176 | A | * | 12/1960 | Smith | 405/3 |
| 3,021,965 | A | | 2/1962 | Harvey | |
| 3,753,355 | A | * | 8/1973 | Knoch | 405/3 |
| 3,863,890 | A | | 2/1975 | Ruffing | |
| 4,022,027 | A | * | 5/1977 | Tetzner | 405/3 |
| 4,773,346 | A | * | 9/1988 | Blanding et al. | 405/3 |
| 4,787,327 | A | * | 11/1988 | Porter | 405/3 |
| 4,850,741 | A | | 7/1989 | Timmerman | |
| 4,895,479 | A | | 1/1990 | Michaelsen et al. | |
| 5,184,914 | A | | 2/1993 | Basta | |
| 5,275,505 | A | | 1/1994 | Wilcox | |
| 5,888,019 | A | * | 3/1999 | Quastad | 405/3 |
| 5,890,835 | A | | 4/1999 | Basta et al. | |
| 5,908,264 | A | | 6/1999 | Hey | |
| 5,919,000 | A | | 7/1999 | Unkle | |
| 6,032,601 | A | * | 3/2000 | Gates | 405/3 |

* cited by examiner

*Primary Examiner*—Heather Shackelford
*Assistant Examiner*—Frederick Lagman
(74) *Attorney, Agent, or Firm*—Wall Marjama & Bilinski LLP

(57) ABSTRACT

A boat lift having a stationary frame and a lifting frame that can be raised and lowered on the stationary frame. The lifting frame has a front cross member and a rear cross member. A pair of bunk rails are adjustably mounted upon the cross members so that the rails can be pre-positioned to better conform to the shape of the hull of a boat being serviced by the lift.

9 Claims, 4 Drawing Sheets

BOAT LIFT

FIELD OF THE INVENTION

This invention relates to a boat lift and, in particular, to a hydraulically operated boat lift for raising a boat out of the water.

BACKGROUND OF THE INVENTION

Many boaters wish to dock their boats out of the water in order to reduce the amount of waterborne contamination that might collect upon the hull. Keeping the vessel out of the water when not in use also helps to preserve components from damage and deterioration caused by water. In addition, the craft can be more easily repaired and maintained when raised well clear of the water. Furthermore, in certain geographic locales that experience relatively mild winters, the lift can remain in the water year round and can be used to store the boat during the winter months.

As described by Hey in U.S. Pat. No. 5,908,264, many boat lifts currently in use include a main frame that is supported beneath the surface of the water upon legs or the like. A pair of spaced apart parallel bunk rails are mounted upon the frame by lifting arms so that rails can be raised by hydraulic cylinders from a home or boat receiving position beneath the water to an elevated or raised position wherein the boat is lifted free of the water. Although this type of lifting device works well in practice, it has one drawback in that the parallel bunk rails generally do not conform to the various and diverse shapes of many boat hulls and, as a consequence, the boat being serviced by the lift can be seated in the bunk rails in a potentially unstable condition. In addition, because the bunk rails are located beneath the water when in the lowered or boat receiving position, it is oftentimes difficult for the boat operator to guide the boat properly onto the bunk rails.

SUMMARY OF THE INVENTION

It is, therefore, an object of the present invention to improve apparatus for lifting boats out of the water.

It is a further object of the present invention to more securely support a water craft upon the bunk rails of a hydraulic or pneumatic boat lift.

A still further object of the present invention is to provide the bunk rails of a boat lift with sufficient adjustability such that the rails can be set to better conform to the shape of a boat's hull.

Another object of the present invention is to simplify the guiding and aligning of a boat onto the bunk rails of a boat lift.

Yet another object of the present invention is to improve the safety of hydraulic and pneumatic boat lifts.

These and other objects of the present invention are attained by a boat lift that includes a rectangular-shaped stationary frame that is supported by legs beneath the surface of a body of water. A rectangular-shaped lifting frame having spaced apart front and rear laterally disposed cross members is mounted over the stationary frame. The lifting frame is connected to the stationary frame by lifting arms which guide the lifting frame between a first lowered boat receiving position beneath the water and a second raised position wherein the boat is elevated out of the water. Hydraulic or pneumatic cylinders are employed to raise and lower the lifting frame. A pair of bunk rails are mounted upon the cross members of the lifting frame by adjustable retainers for locating each bunk rail independently upon the cross member and thus to allow the rails to be positioned in close conformity with the shape of a hull. A pair of raised guide rails are also adjustably mounted upon the lifting frame so that the guide rails extend upwardly above the surface of the water when the lifting frame is in the lowered or boat receiving position and serves to help the boat operator guide the boat onto the bunk rails.

BRIEF DESCRIPTION OF THE DRAWING

For a further understanding of these and other objects of the invention, reference will be made to the following detailed description of the invention which is to be read in connection with the accompanying drawing, wherein.

DETAILED DESCRIPTION OF THE INVENTION

Figure 1:
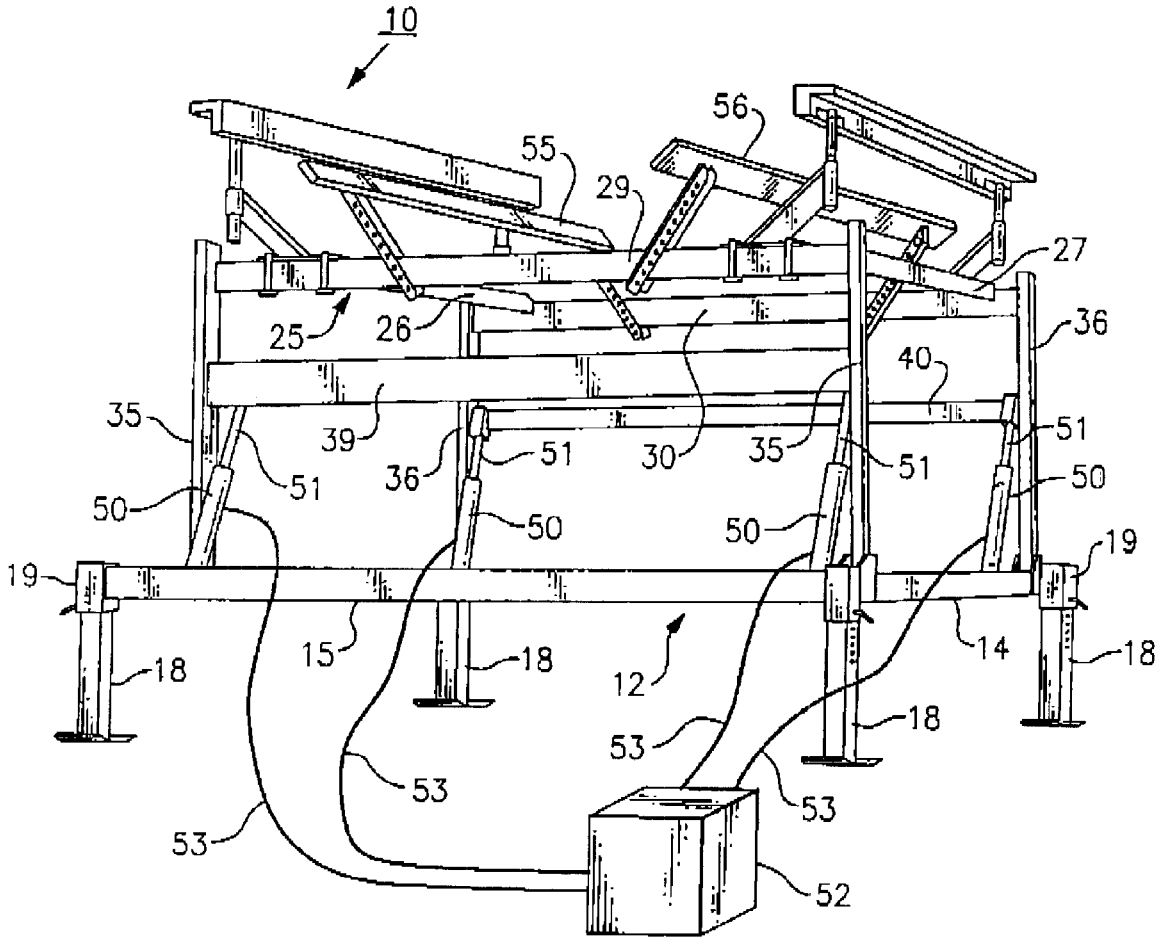
FIG. 1 is a perspective view of a boat lift embodying the present invention illustrating the lift in a fully raised position.
Figure 2:
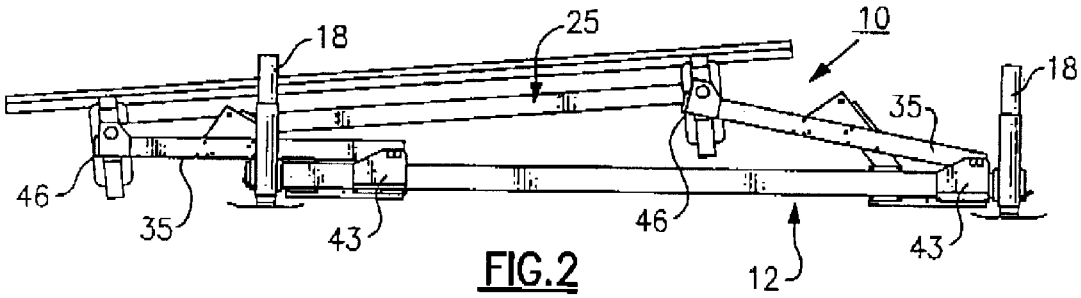
FIG. 2 is a side elevation of the lift shown in FIG. 1 illustrating the lift in a fully lowered boat receiving position.
Figure 7:
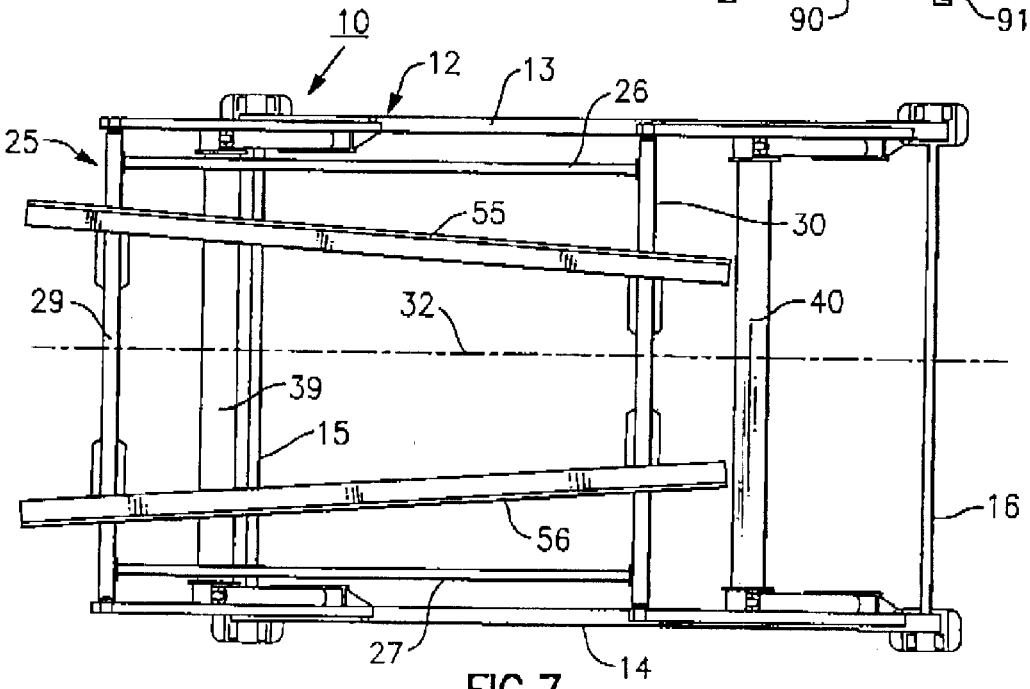
FIG. 7 is a top plane view of the boat lift showing the bunk rails canted upon the cross members of the lifting frame.

Turning initially to FIGS. 1, 2 and 7, there is illustrated a hydraulically-operated boat lift, generally referenced 10, that embodies the teachings of the present invention. The boat lift includes a main stationary frame 12 that is rectangular in form and contains a pair of opposed side beams 13 and 14 that are connected by a pair of end beams 15 and 16 to establish a four-sided open frame. Adjustable legs 18 are slidably contained within retainers 19 mounted upon the opposed ends of the two end beams 15 and 16. A series of spaced apart holes are vertically formed in each leg that are arranged to receive therein locating pins so that they can be mounted in each retainer. The length of each leg can be adjusted whereby the stationary frame can be supported in a horizontal plane in a body of water having an uneven bed. Such adjustable legs are well known in the art and, therefore, will not be described herein in greater detail.

Figure 4:
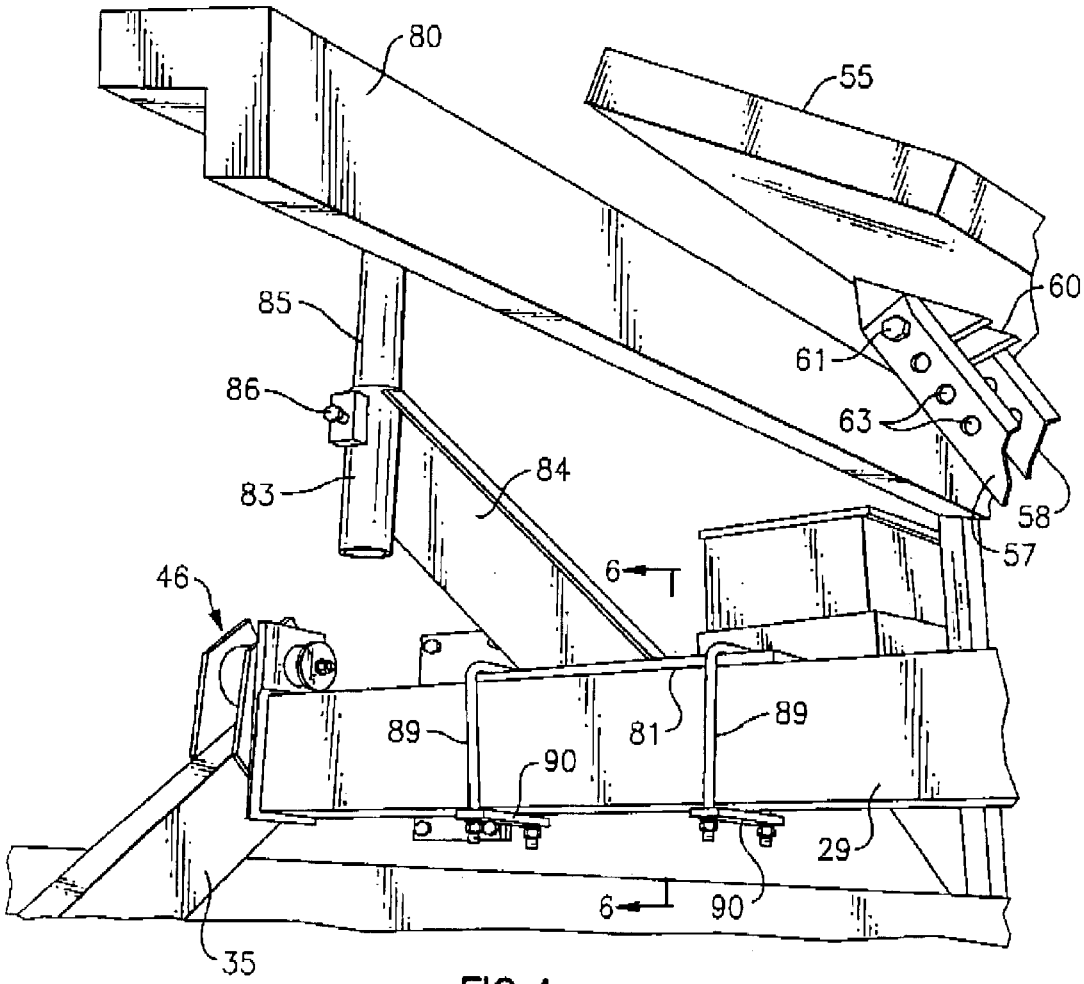
FIG. 4 is a further enlarged perspective view showing the mechanism for adjusting the guide rails of the lift.
Figure 3:
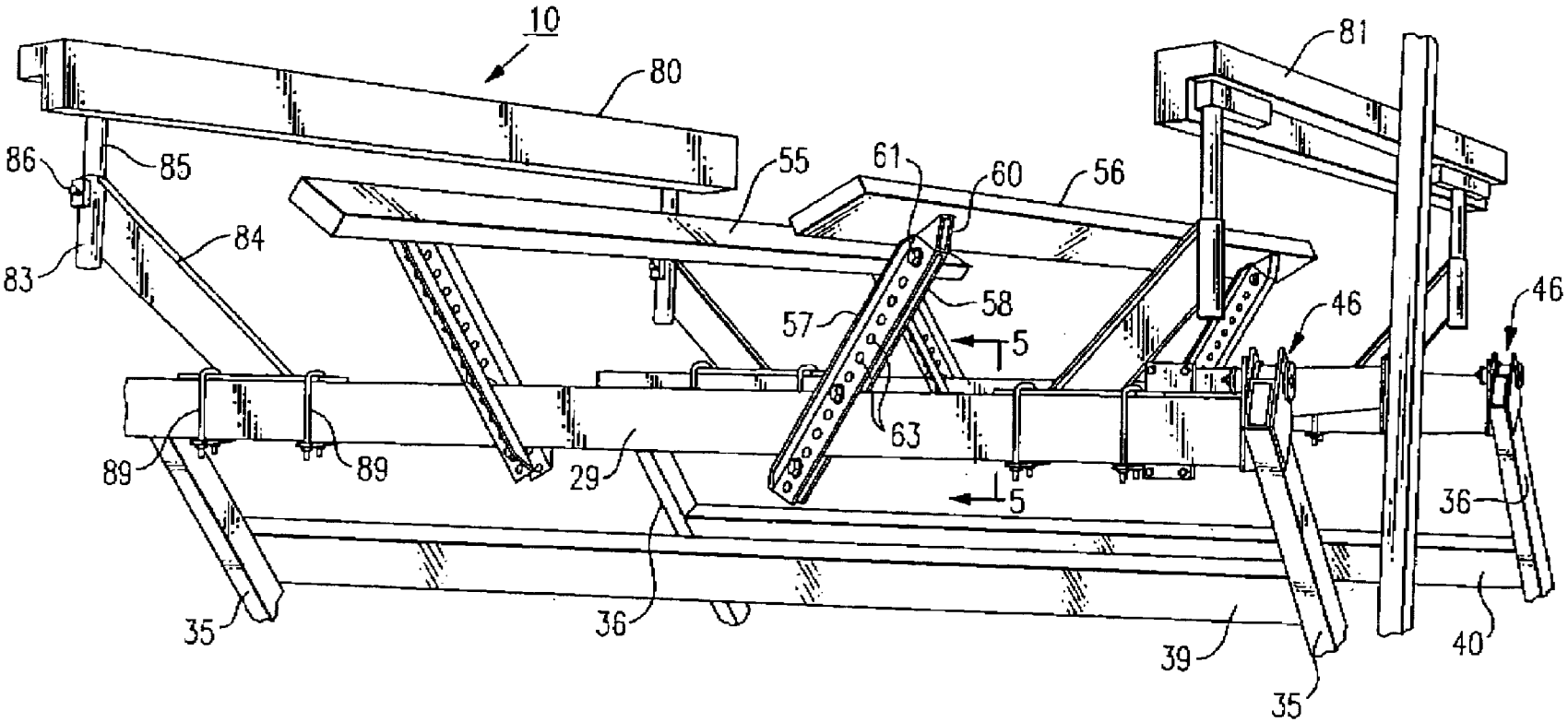
FIG. 3 is an enlarged partial perspective view showing the lifting frame in greater detail.

The boat lift 10 further includes a second lifting frame, generally designed 25 which includes a pair of side members 26 and 27 that are conjoined by spaced apart end members 29 and 30. In practice, the stationary frame and the moveable lifting frame are about the same length and width and each frame is centered upon a common axis 32 (FIG. 7). The two frames are interconnected by two front lifting arms 35—35 and two rear lifting arms 36—36. The two front lifting arms are rigidly connected by a front cross brace 39 and the two rear lifting arms are similarly connected by a rear cross brace 40. A best illustrated in FIG. 2, one end of each lifting arm is rotatably supported in a pivot mount 43 secured in the support frame. The opposite ends of each lifting arm are rotatably supported on the outboard ends of the two end members 29 and 30 of the movable lifting frame by means of rotor assemblies 46, one of which is illustrated in greater detail in FIG. 4.

Lifting cylinders 50 are rotatably connected to the stationary frame at each inside corner of the frame. The piston rods 51 associated with the two lifting cylinders at the front corners of the stationary frame are each pivotably secured to the front cross brace 39 that interconnects to two front lifting arms. The piston rods of the two lifting cylinders at the rear corners of the support frame are similarly pivotably connected to the cross brace 40 that interconnects the two rear lifting arms. The lifting cylinders are arranged to bring the lifting frame to a fully lowered position when the piston rods are retracted into the cylinders and to bring the lifting frame to a fully elevated position when the piston rods are extended. The cylinders are connected to a controller 52 by suitable lines 53—53 so that the lift can be operated from a remote location such as a dockside station or the like. Although four lifting cylinders are employed in this embodiment of the invention, it may be desirable to employ only two cylinders mounted at either the front or rear corners of the stationary frame on smaller versions of the boat lift designed to service relatively lighter weight boats.

The lifting arms and cylinders are arranged so that the movable lifting frame is situated at a slight angle with reference to the horizontally disposed stationary frame when the lifting frame is placed in the home position as illustrated in FIG. 2 so that the lifting frame slants upwardly from the front of the lift towards the back of the lift. This allows the bow of the boat being serviced to pass well over the lifting frame into contact with a pair of bunk rails 55 and 56 that are mounted upon the lifting frame. The lifting arms are further arranged to move the lifting frame into a horizontal plane when the lifting frame is brought to a fully raised position as illustrated in FIG. 1.

Figure 5:
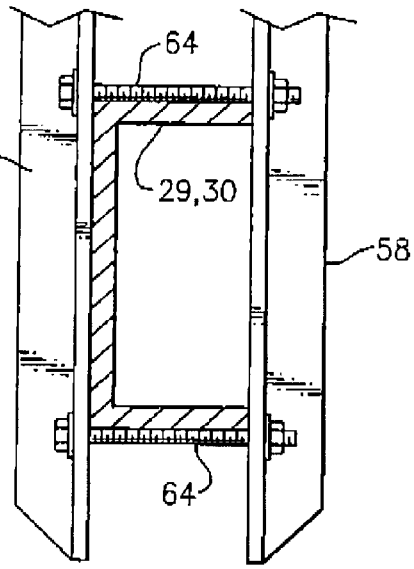
FIG. 5 is an enlarged sectional view taken along lines 5—5 in FIG. 3.

First each bunk rail contains a pair of elongated jaws 57 and 58 located at the front section of the rail and at a second pair of similar jaws located at the rear of the rail. Each set of jaws is of the same construction and, therefore, only one set will be described in detail herein. Each of the two jaws in a set are pivotably connected to the underside of the bunk rail by a mounting bracket 60. The two elongated jaw members are suspended in the bracket by a pivot 61 that passes through clearance holes formed in both the jaws and the bracket. The jaws are arranged so that they will hang down from the bracket to either side of an adjacent front or rear end member of the lifting frame as illustrated in FIG. 5. Each jaw member is provided with a series of spaced apart holes 63—63 with the holes in one jaw member being aligned with the holes in the other jaw member. In assembly, bolts 64 are passed through aligned holes on either side of the associated end member and, when tightened down, securely clamps the bunk rail to the end member at the front and rear of the lift. Sufficient clearance is provided in the holes formed in the jaw members and the brackets that allow a good deal of flexibility in the positioning of the bunk rails on the end members of the movable lifting frame. Accordingly, the bunk rails can be canted inwardly from front to back as illustrated in FIG. 7 to conform to the shape of a hull of a boat being serviced by the lift. In addition, the positioning of jaws can be adjusted to change the height and inclination of the rails.

A pair of raised guide rails 80-80 are also mounted upon end members 29 and 30 of the lifting frame. The guide rails are mounted outboard of the bunk rails and are elevated to a height above the bunk rails so that the guide rails are supported well above the water level when the lifting frame is in the lowered or home position. The guide rails are adjustably mounted upon the end member of the frame so that they can be spaced apart a desired distance that is slightly greater than the beam of the boat being serviced by the lift at a prearranged height above the water line.

Figure 6:
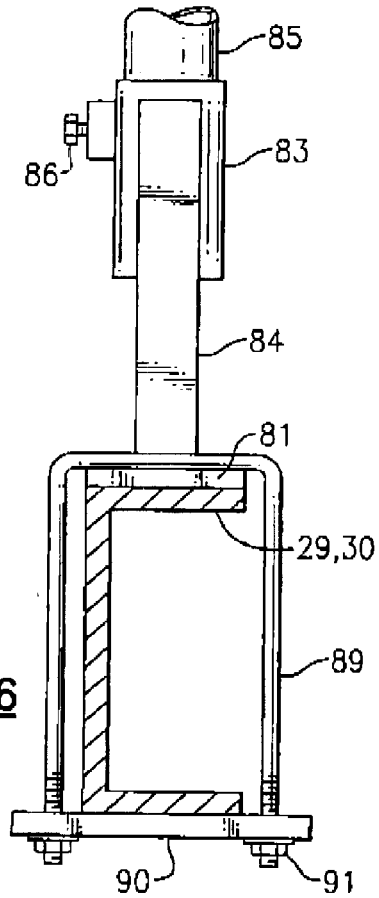
FIG. 6 is an enlarged sectional view taken along lines 6—6 in FIG. 4.

As illustrated in FIG. 6, the front and rear sections of each guide rail are mounted upon a slide 81 that rests in sliding contact on the top surface of an associated end member 29,30. A circular sleeve 83 is secured to the slide by a connecting bar 84 so that the sleeve is generally vertically disposed in assembly. A circular rod 85 is slidably contained within the sleeve and is secured at its upper end to the guide rail by any suitable means. The rod 85 is releasably secured in the sleeve 83 by means of a set screw 86 that is threaded into the sleeve and arranged to lock the rod in a desired position. As can be seen, the height of the guide rail can be selectively adjusted to any suitable elevation.

A pair of U-shaped bolts 89 are mounted upon the slide as illustrated in FIG. 6 so that the two arms of the bolt pass downwardly along the opposite sides of the supporting end member. Both ends of the bolts are threaded and are arranged to pass through clearance holes formed in a clamping bar 90. A lock nut 91 is threaded upon each end of the bolt and when tightened down, locks the slide 81 to the end member. Here again, it should be evident that the slides can be selectively positioned upon the end members so that the guide rails can be set at a desired distance apart.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A boat lift for raising a boat out of a body of water that includes:

a rectangular stationary frame lying in a given plane and having a central axis;

a rectangular lifting frame lying in a plane that is parallel with said given plane, said lifting frame having a front end and a back end and a central axis that is in coplanar alignment with the central plane of said stationary frame;

means for raising and lowering said lifting frame upon said stationary frame;

a first front end member mounted at the front end of said lifting frame and a second back end member mounted at the back end of said lifting frame, said end members being perpendicular to said central axis of said lifting frame;

a pair of opposed bunk rails, mounted on either side of said central axis of said lifting frame, each bunk rail having a first clamping means for independently securing a first end of the bunk rail to the front end member and a second clamping means for independently securing a second end of the bunk rail opposite said first end to the back end member so that each end of the bunk rail can be independently positioned upon the end member whereby the rails can engage the hull of a boat to be raised by said lifting frame, wherein the independent positioning of each of the ends of said opposed bunk rails upon said end members permits hulls of varying shape to be supported thereupon.

2. The boat lift of claim 1 wherein said first and second clamping means each further include adjusting means for independently adjusting the height of the bunk rail at each end thereof.

3. The boat lift of claim 1 that further includes at least two hydraulic lifting cylinders arranged to act between the frames for moving the lifting frame between a lowered boat receiving position beneath the water and an elevated position wherein the boat is lifted out of the water.

4. The boat lift of claim 1 wherein said clamping means includes a pair of spaced apart elongated jaws that are secured at one end to the underside of a bunk rail and the jaws passing downwardly along opposite sides of said end member.

5. The boat lift of claim 4 wherein jaws have a series of aligned holes located along the length of each jaw and threaded fasteners arranged to pass between aligned holes located over and under the end member.

6. The boat lift of claim 1 that further includes a pair of opposed guide rails, each guide rail having a first slide member slidably mounted upon the front end member outside of said first clamping means and a second slide member mounted on said back end member outside of said second clamping means.

7. The boat lift of claim 6 that further includes adjustable legs for adjusting the height of each guide rail.

8. The boat lift of claim 7 that further includes means for locking each slide member to an end member at a desired location.

9. The boat lift of claim 1, wherein said bunk rails can be positioned in a configuration wherein said bunk rails are non-parallel with one another.

* * * * *